United States Patent [19]

Komiya et al.

[11] 4,338,544

[45] Jul. 6, 1982

[54] FLUORESCENT LAMP

[75] Inventors: Akitoshi Komiya, Odawara; Toshiharu Yagi, Hyogo; Akiyoshi Kondo, Yokosuka, all of Japan

[73] Assignee: Tokyo Shibaura Denki Kabushiki Kaisha, Kawasaki, Japan

[21] Appl. No.: 127,549

[22] Filed: Mar. 6, 1980

[30] Foreign Application Priority Data

Mar. 14, 1979 [JP] Japan ..... 54/28601

[51] Int. Cl.[3] ..... H01J 61/54

[52] U.S. Cl. ..... 313/489; 313/492; 313/198; 313/291

[58] Field of Search ..... 313/485, 488, 489, 197, 313/198, 491, 492, 291

[56] References Cited

U.S. PATENT DOCUMENTS 3,967,153 6/1976 Milke et al. ..... 313/489

*Primary Examiner*—Eugene R. La Roche

*Attorney, Agent, or Firm*—Cushman, Darby & Cushman

[57] ABSTRACT

A fluorescent lamp comprising a glass envelope contains a mixed gas of a mercury gas and at least one kind selected from neon, xenon and krypton or a mixture of said mixed gas and argon. A transparent electroconductive film is formed on the inner surface of said glass envelope; an aluminum oxide film is formed on said transparent electroconductive film, and a phosphor film is formed on the aluminum oxide film, in which an amount of the deposit of said aluminum oxide film per unit deposition area is equal to or greater than $2.6\times10^{-2}$ mg/cm$^2$.

3 Claims, 3 Drawing Figures

FLUORESCENT LAMP

This invention relates to a fluorescent lamp comprised of a glass envelope having a low-pressure mercury vapor sealed therein, and in particular to a fluorescent lamp having a transparent electroconductive film to aid in starting which is formed on the inner surface of an envelope.

Recently, this type of fluorescent lamp has gained a wider acceptance due to its rapid starting characteristic and ease of manufacture. However, a transparent electroconductive film made of tin oxide etc. suffers a reaction with mercury to produce a "blackening" phenomenon after a lapse of time. Japanese Patent Disclosure No. 51-76877—the applicant: Sylvania Incorporated U.S.A.—discloses a fluorescent lamp directed to primarily solving such a blackening phenomenon. In such a fluorescent lamp, the envelope has, in addition to a mercury gas, an argon gas sealed therein, and a transparent electroconductive film, aluminum oxide film and phosphor film are deposited in that order on the inner surface of the envelope. In the fluorescent lamp of the above-mentioned Japanese Patent Disclosure the blackening phenomenon is suppressed and the starting voltage is lowered to a practically allowable level. However, the capability of reducing a dissipation power is not necessarily satisfactory.

It is accordingly the object of this invention to provide a fluorescent lamp with less of a blackening phenomenon. A better starting characteristic, a lesser luminous flux reduction rate and a lower dissipation power.

In order to attain this object there is provided a fluorescent lamp comprising a glass envelope in which a mixed gas of a mercury gas and at least one kind of neon, xenon and krypton, or a mixture of the mixed gas and argon, is sealed; a transparent electroconductive film is formed on the inner surface of the envelope. A aluminum oxide film is formed on the electroconductive film is and a phosphor film formed on the aluminum oxide film, in which an amount of the deposit of aluminum oxide film per unit deposition area is equal to or greater than $2.6\times10^{-2}$ mg/cm$^2$. In the above-mentioned fluorescent lamp, an amount of the deposit of the phosphor film is preferably in a range of 2.9 to 4.3 mg/cm$^2$.

This invention will be explained below by way of example by reference to the accompanying drawings, in which.

Figure 1:
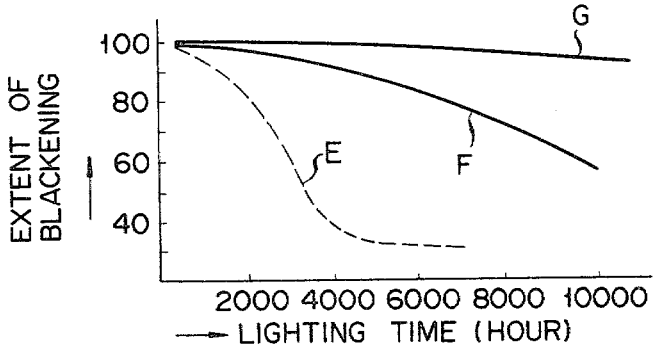
FIG. 1 is a graph showing a relation of the lighting time of a fluorescent lamp to the extent of blackening.

FIG. 1 is a graph showing a relation of the lighting time of a fluorescent lamp to the extent of blackening. (This shows the extent of blackening per fluorescent lamp with no blackening indicated as 100 and thus the smaller the extent of blackening the nearer it becomes to 100.) For convenience of explanation, the word "extent of blackening" is used interchangeably with a "blackening count". In the Figure, E shows a curve of a fluorescent lamp in which a phosphor film is formed directly on a transparent electroconductive film on which no alumina film is formed, F shows a curve of a fluorescent lamp having a 0.5μ-thick alumina film between a phosphor film and an electroconductive film, and G shows a curve of a fluorescent lamp having a 2.0μ-thick alumina film formed between an electroconductive film and a phosphor film. Each of these fluorescent lamps is a 40W fluorescent lamp of a rapid start type with a glass envelope in which a rare gas composition consisting 50% by volume of argon, 45% by volume of krypton and 5% by volume of neon are sealed. The whole resistive value of the electroconductive film of the respective fluorescent lamps is set at 10 to 20 KΩ.

As seen from FIG. 1, the presence or absence of the alumina film manifests a marked difference in effect 3,000 hours after the fluorescent lamp is lighted. That is, the prevention of the blackening phenomenon is heightened in proportion to an increase in the thickness of the alumina film. Lamps of the same type as those under the curves F and G were tested under the identical conditions except that an aluminum film of above 2.0μ was used. Though not shown in FIG. 1, these tested lamps reveal the same prevention of the blackening phenomenon as that under the curve G. However, the use of too thick an alumina film is not economically desirable. The following table shows a relation between an amount of alumina deposit (in mg) formed on the inner surface of a glass envelope for a fluorescent lamp and the thickness (in μ) of the alumina deposition film. In this case, the alumina film is formed by coating the inner surface of a vertically-held glass tube with an emulsion containing alumina powder and drying it. The thickness of the alumina film somewhat varies from a location to a location to be measured. As seen from the following Table, the alumina film on one end portion, i.e. the upper end portion, of the vertically-held glass tube is thinner than that on the other end portion, i.e. the lower end portion, of the glass envelope.

TABLE

| Location to be measured | Amount of deposit | | | | | | |
|---|---|---|---|---|---|---|---|
| | 20mg | 30mg | 50mg | 80mg | 100mg | 120mg | 280mg |
| One end portion | 0.31μ | 0.50μ | 0.51μ | 0.57μ | 0.67μ | 0.80μ | 2.02μ |
| Central portion | 0.34μ | 0.50μ | 0.55μ | 0.68μ | 0.75μ | 1.10μ | 3.05μ |
| Other end portion | 0.40μ | 0.55μ | 0.60μ | 0.72μ | 0.80μ | 1.20μ | 3.76μ |

Figure 2:
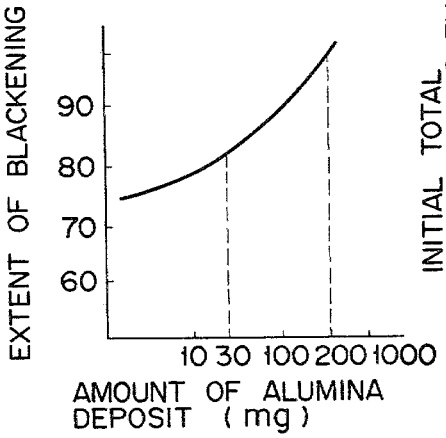
FIG. 2 is a graph showing a relation of an amount of alumina deposit to the extent of blackening 5,000 hours after the lighting of the fluorescent lamp.

FIG. 2 is a graph showing a relation of an amount of alumina deposit (in mg) to the extent of blackening 5,000 hours after the fluorescent lamp is lighted. As evident from FIG. 2, for an alumina deposit of above 30 mg, a blackening count of above 80 can be maintained even after 5,000 hours from the lightening of the fluorescent lamp. Such a blackening phenomenon preventing capability falls well within a practically allowable range. The alumina deposit of 30 mg, if calculated in terms of the unit deposition area, becomes $2.6\times10^{-2}$ mg/cm$^2$. This value, if calculated in terms of the alumina film thickness, becomes about 0.5$\mu$ as shown in the table although it is dependent upon the location of the alumina deposition film formed.

Figure 3:
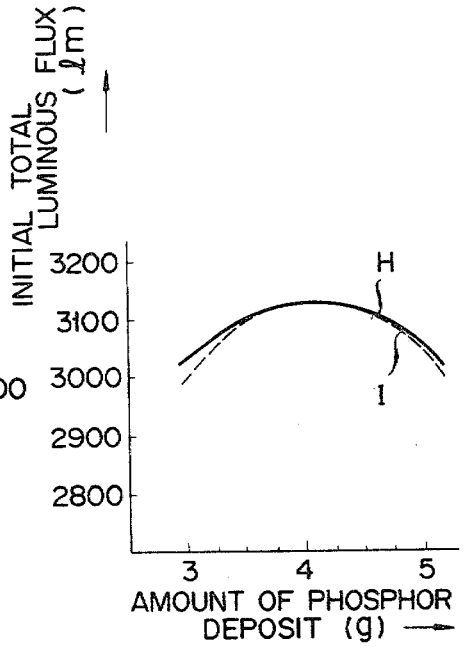
FIG. 3 is a graph showing a relation between an amount of the phosphor deposit and an initial total luminous flux of the fluorescent lamp when the amount of the alumina deposit is used as a parameter.

FIG. 3 is a graph showing a relation between the initial total luminous flux (in lm) and an amount of phosphor deposit (in g) when the alumina deposit is used as a parameter.

In FIG. 3, the curve H shows a fluorescent lamp having a 0.5 to 2.0$\mu$-thick alumina deposition film and the curve I shows a fluorescent lamp whose alumina deposition film has a thickness of about 2.0 N. In order to cause the total luminous flux of the fluorescent lamp to be maintained at 3,000 lm 100 hours after the lightening of the lamp it is practically necessary that a luminous flux reduction rate as measured from a zero hour be maintained at 2 to 3% and that the fluorescent lamp have an initial total luminous flux of 3,050 to 3,100 lm at a zero hour. As evident from the curves H and I in FIG. 3, 3.3 g to 4.8 g of the phosphor deposit satisfies the initial total luminous flux of above 3,050 lm. When the amount of alumina deposit exceeds 4.8 g, the phosphor film is undesirably peeled off the inner surface of the glass envelope during the manufacture of the fluorescent lamp. The alumina deposit of 3.3 g to 4.8 g, if calculated in terms of the unit deposition area, becomes 2.9 to 4.3 mg/cm$^2$.

What we claim is:

1. A fluorescent lamp, comprising:

a glass envelope containing a mercury gas and at least one other gas selected from neon, xenon and krypton;

a transparent electroconductive film formed on the inner surface of said glass envelope;

an aluminum oxide film formed on said transparent electroconductive film; and a phosphor film formed on the aluminum oxide film, in which the amount of said aluminim oxide film thickness is from 0.5 $\mu$m to 2.0 $\mu$m.

2. A fluorescent lamp according to claim 1, in which said other gas further includes argon.

3. A fluorescent lamp according to claim 1 or 2, in which an amount of a deposit of the phosphor film per unit deposition area is 2.9 to 4.3 mg/cm$^2$.

* * * * *